US006568572B1

(12) United States Patent
Smith

(10) Patent No.: US 6,568,572 B1
(45) Date of Patent: May 27, 2003

(54) GLOVE INVERTER

(75) Inventor: Gregory John Smith, 474 Jean St., Oakland, CA (US) 94610

(73) Assignee: Gregory John Smith, Oakland, CA (US)

( * ) Notice: Subject to any disclaimer, the term of this patent is extended or adjusted under 35 U.S.C. 154(b) by 0 days.

(21) Appl. No.: 09/925,097

(22) Filed: Aug. 8, 2001

(51) Int. Cl.[7] ..... A41M 43/00
(52) U.S. Cl. ..... 223/42; 223/40; 223/1
(58) Field of Search ..... 223/111, 1, 39, 223/40, 41, 42

(56) References Cited

U.S. PATENT DOCUMENTS

| | | | | | |
|---|---|---|---|---|---|
| 620,356 | A | * | 2/1899 | Pratt | 223/39 |
| 698,956 | A | * | 4/1902 | Jarvis | 223/39 |
| 881,155 | A | * | 3/1908 | Robinson | 223/39 |
| 993,937 | A | * | 5/1911 | Abbott | 223/39 |
| 1,735,688 | A | * | 11/1929 | Lowry | 223/39 |
| 3,762,613 | A | * | 10/1973 | Hardaker | 223/40 |
| 4,689,897 | A | | 9/1987 | Marsalona | 34/103 |
| 4,947,486 | A | | 8/1990 | Hsuih | 2/164 |
| 5,125,169 | A | | 6/1992 | Bader | 34/103 |
| 5,392,970 | A | | 2/1995 | Orosei | 223/39 |
| 5,604,993 | A | | 2/1997 | Auckerman | 34/104 |
| 5,913,461 | A | | 6/1999 | Boudreau et al. | 223/78 |
| 6,076,713 | A | | 6/2000 | Boudreau et al. | 223/78 |

* cited by examiner

*Primary Examiner*—Bibhu Mohanty

(57) ABSTRACT

A device for inverting gloves, especially industrial-heavy-duty-lined-rubber gloves, wherein a shallow hole exists in the center of the top of the base (1) wherein the pushrod fits and the tube (3), wherein the length thereof is shorter than the pushrod (2) and provides for an inside diameter that is sufficient to accommodate a pushrod (2) freely without hindrance. Inserting the glove appendage tip into the tube (3), thereafter introducing the tube (3) conversely into the glove appendage socket. Subsequently the pushrod (2) base (1) assembly is inserted into the tube (3) and pushed through the tube (3) accomplishing inversion efficiently and expediently.

1 Claim, 5 Drawing Sheets

GLOVE INVERTER

FEDERALLY SPONSORED RESEARCH

Not Applicable

SEQUENCE LISTING OR PROGRAM

Not applicable

BACKGROUND-INCEPTION OF INVENTION

The inception of this invention arose from my personal experience in the pearl and construction industry in Japan. I spent too much of my break time turning rubber gloves inside-out by hand to clean and dry them. I discontinued this practice because it was too time comsuming and as a results, I began to have serious problems with my hands including redness, itching, chaffing, etc. I searched for a device to invert rubber gloves at numerous outlets that cater to industries utilizing industrial-heavy-duty-lined-rubber gloves, but to no avail.

BACKGROUND-FIELD OF INVENTION

My glove inverter relates to gloves, especially industrial-heavy-duty-lined-rubber gloves, specifically to facilitate the expedient and efficient inversion and subsequent sanitation and desiccation thereof. The fields in which industrial-heavy-duty-lined rubber gloves are utilized span the gamut from the Oil Industry, Chemical Industry, Waste Management, Construction Industry, Aquatic Industry, Janitorial Industries, etc., to home usage. Perspiration soaked, lined rubber gloves are difficult and time consuming to invert for sanitation and desiccation purposes. Also the bacteria and fungus which thrive and multiply in moist, unsanitary rubber gloves precipitates a plethora of health complications ranging from discomfort due to itching, chaffing, sore hands, to more severe ailments associated with improper sanitation and desiccation.

BACKGROUND-PRIOR ART

U.S. Pat. No, 5,392,970 to Orosei (1995) is the closest prior art related to my glove inverter. Even though it performs the same function as my glove inverter, it pertains to a field other than my glove inverter and contrary to U.S. Pat. No. 5,392,970 to Orosei (1995), my glove inverter is lighter, detachable, and portable.

OBJECTS AND ADVANTAGES

The purpose of my glove inverter is to promote good hygiene in the workplace and at home by offering an expedient and trouble free method for inverting gloves, especially industrial-heavy-duty-lined-rubber gloves, thereby facilitating efficient and effective sanitation and desiccation. Sanitary, desiccated gloves ameliorate the condition of the hands by eliminating the agitation and stress caused by discomfort due to redness, soreness, chaffing, psoriasis, ringworm, or worse.

My glove inverter is very practical and very simplistic in its application and expedites the process of inverting gloves effectively and efficiently. Furthermore, it provides a highly reliable, lightweight, detachable, portable, yet economical device that can be used by persons of almost any age. Further objects and advantages will become apparent from a consideration of the photos and ensuing description.

SUMMARY

In accordance with the present invention my glove inverter comprises a base, a pushrod, and a tube. This is a devise for inverting gloves, especially industrial-heavy-duty-lined-rubber gloves, expediently and efficiently thereby facilitating efficient and effective sanitation and desiccation thereof.

BRIEF DESCRIPTION OF VIEWS

In the photos, closely related figures have the same number but different alphabet suffixes.

REFERENCES NUMERALS IN PHOTOS

Part 1=base element or base

Part 2=elongated element or pushrod

Part 3=tubular element or tube

Henceforth reference name and numerals shall be represented by numerals only: Part 1 base=1, Part 2 pushrod=2, Part 3 tube=3.

DETAILED DESCRIPTION

Further characteristics and advantages according to the invention will become apparent from the following detailed description of a preferred but not exclusive embodiment thereof.

This is a device for inverting gloves, especially industrial-heavy-duty-lined-rubber gloves expediently and efficiently thereby facilitating efficient and effective sanitation and desiccation. The dimensions of the elements are determined by the size of the glove that this device is being applied to. Any material, rigid or flexible which is capable of withstanding the pressure necessary to perform the function of this device and can be molded, shaped, cut, cast, manufactured, etc. in the configuration according to the invention can be employed in the construction thereof.

Operation

The operation of my glove device is set forth as follows: once the glove is completely fitted onto the hand, begin taking the glove off, inverting it as much as is possible, simultaneously extracting the hand. Pull all fingers out. Insert any finger of your hand into the cavity of the partially inverted glove appendage that you desire to start with.

Figure 1:
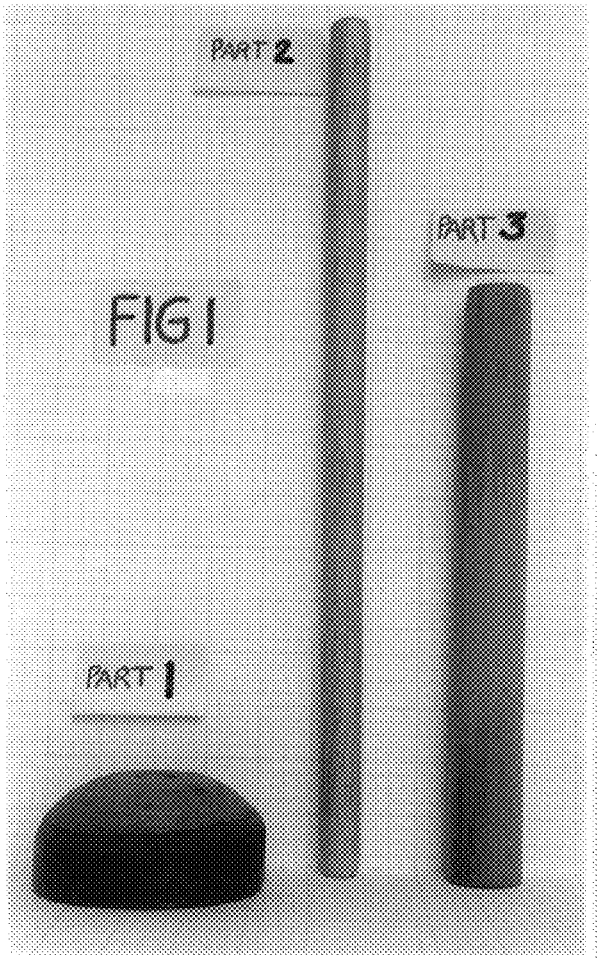
FIG. 1 is a frontal view of the elements of my glove inverter.
Figure 1A:
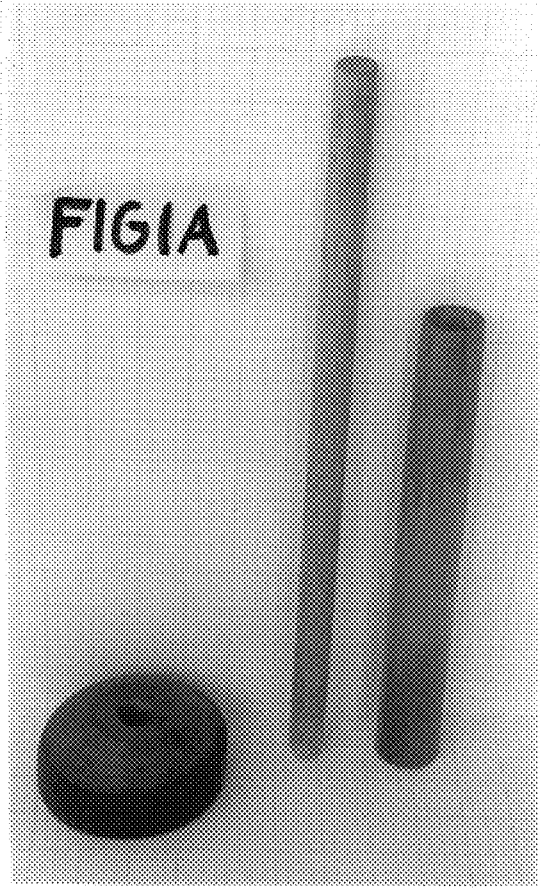
FIG. 1A illustrates FIG. 1 at a 45 degree angle from above.
Figure 2:
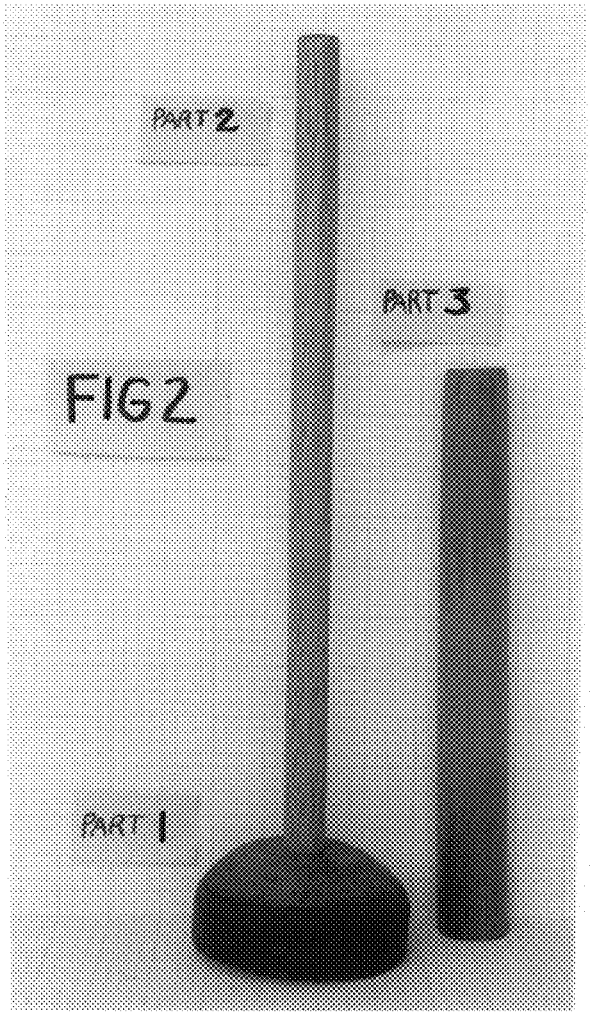
FIG. 2 is a frontal view of the partially assembled elements of my glove inverter.
Figure 2A:
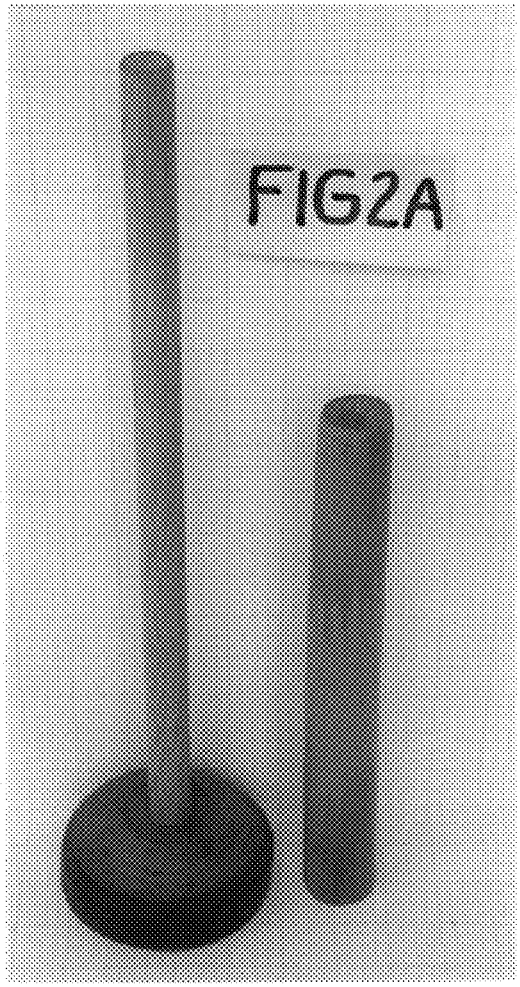
FIG. 2A illustrates FIG. 2 at a 45 degree angle from above.
Figure 3:
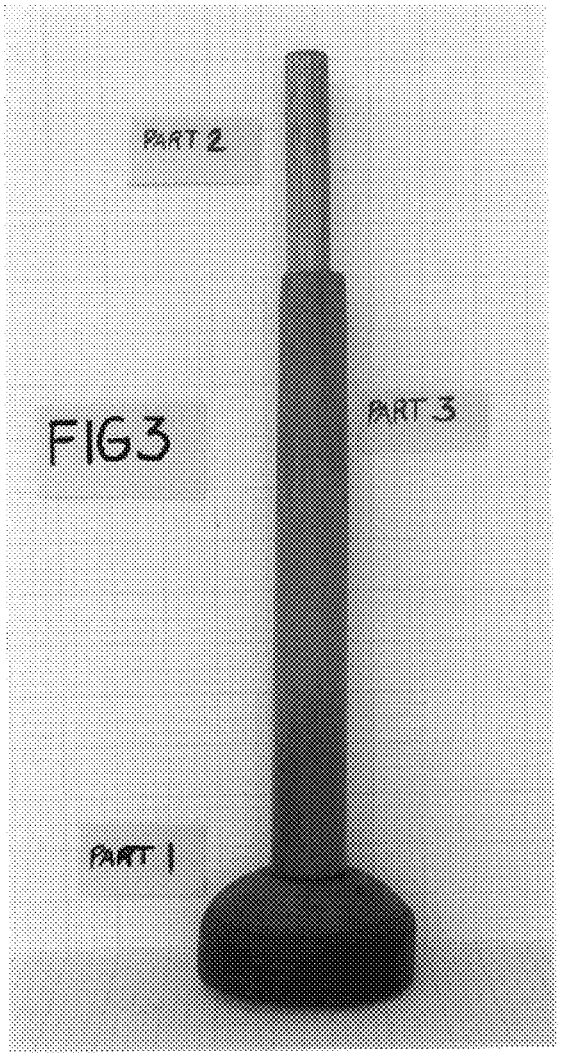
FIG. 3 is a frontal vies of the complete assembly of the elements of my glove inverter.
Figure 3A:
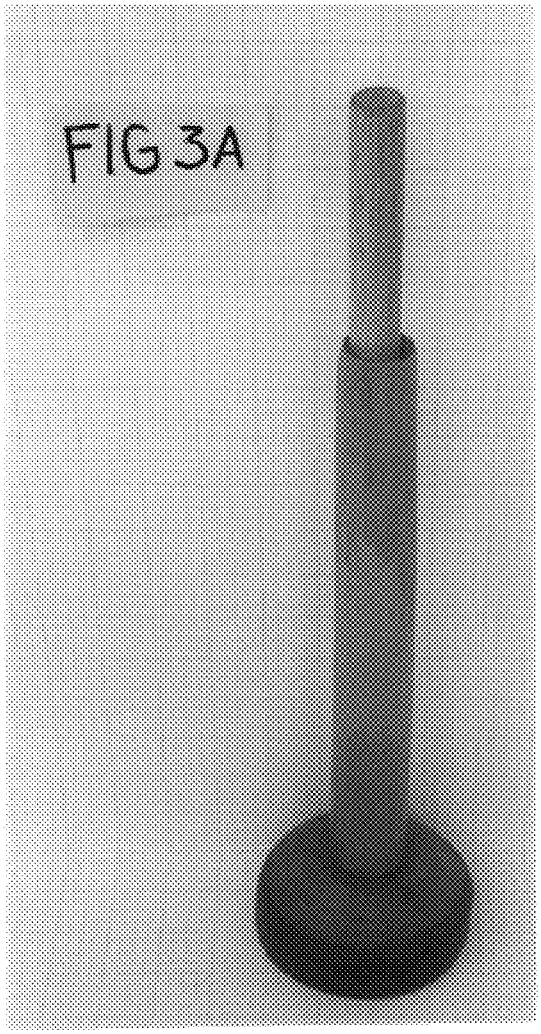
FIG. 3A illustrates FIG. 3 at a 45 degree angle from above.
Figure 4:
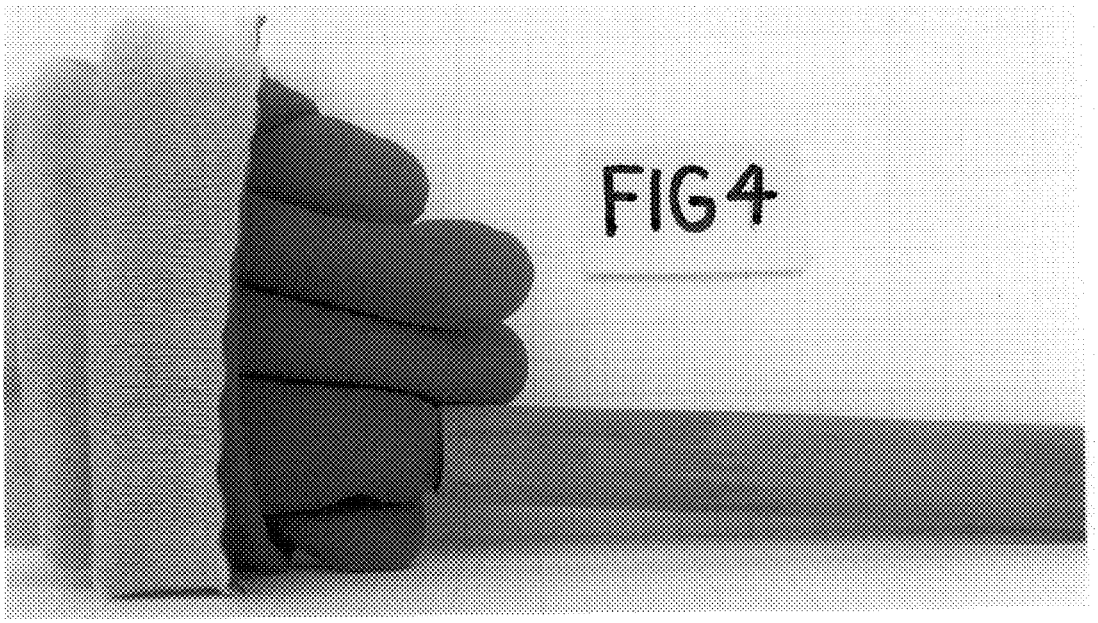
FIG. 4 illustrates step 1 in applying my glove inverter.
Figure 5:
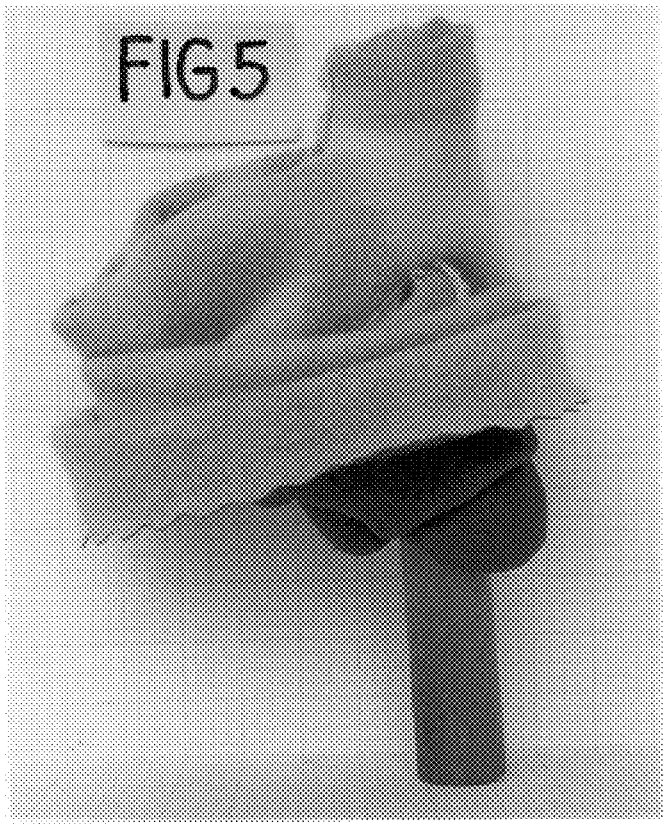
FIG. 5 illustrates step 2 in applying my glove inverter.
Figure 6:
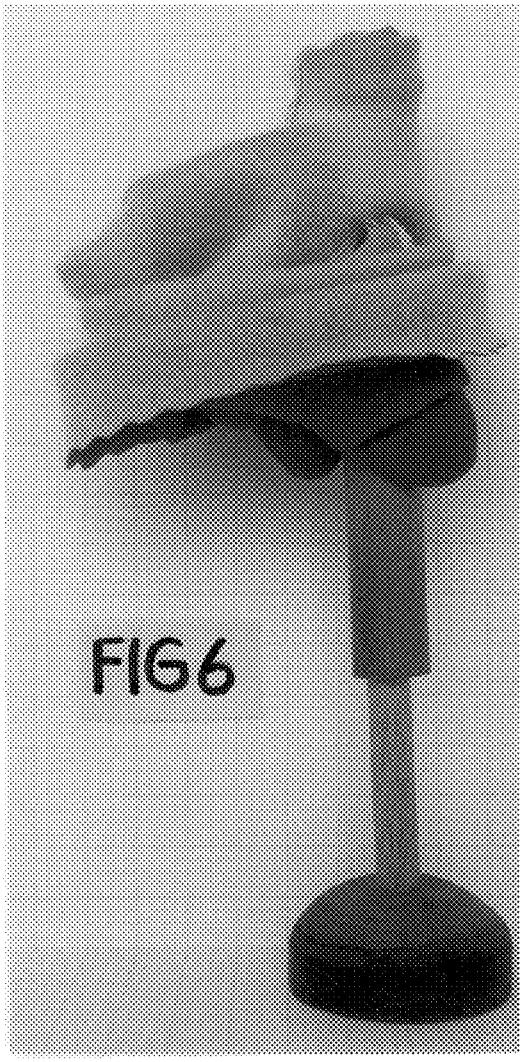
FIG. 6 illustrates step 3 in applying my glove inverter.
Figure 7:
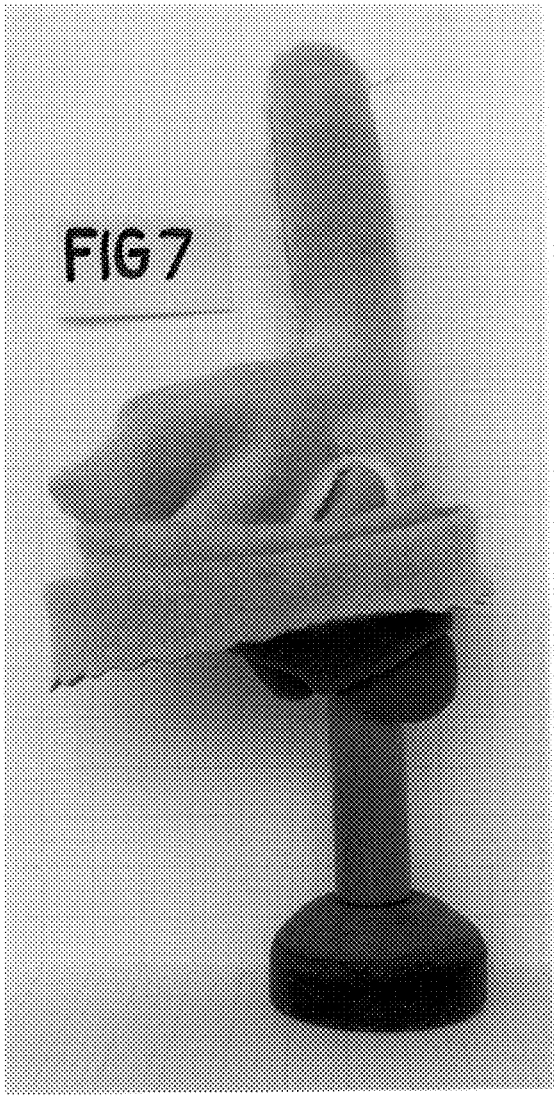
FIG. 7 illustrates step 4 in applying my glove inverter.

Subsequently, insert the tube (3) into the opposite side of the glove where the inserted finger protrudes and fit the tip of that glove appendage into the tube (3). Refer to FIG. 4. Next, push the tube (3) conversely into the glove appendage socket as far as possible while simultaneously extracting the finger. Refer to FIG. 5. Once the tube (3) is securely engaged into the socket, introduce the pushrod (2) fitted into the base (1) into the tube (3). Refer to FIG. 6. Push the base (1) and pushrod (2) assembly up through the tube (3) until complete inversion is accomplished. Refer to FIG. 7. Repeat procedure for the remaining 4 appendages and to turn the glove back to the proper side.

Manufacture

The manufacture of my glove inverter is set forth as follows: the base (1) is a small-semi-circular-oval shape which fits comfortably in the palm of the hand whereof the top has a small-shallow hole in the center wherein the pushrod (2) fits. The pushrod (2) is a cylinder whereof the tip, at the opposite extremity from the base (1), is slightly indented. The tube (3), whereof the tip is tapered wherein the diameter of the interior thereof is sufficient to accommodate the insertion of the pushrod (2) freely without hindrance and the length thereof is shorter than the pushrod (2). The elements of this device can be constructed from any material which can be shaped, molded, cut, cast, manufactured, etc. in the configuration according to the invention such as wood, plastic, metal, rubber, vinyl, laminated fibrous material, composite material, etc.

Prototype

The prototype of my glove inverter depicted in FIGS. 1 through 7 is a device to be applied to a medium-regular sized industrial-heavy-duty-lined-rubber glove. The measurements are delineated as follows: the base (1); the bottom of which is flat and unornamented and the sides are identical and symmetrical; is a semi-circular-oval shaped piece of cherry wood measuring 2.4 cm in height and 5.2 cm by 4.7 cm respectively. It has a hole in the center with a depth of 1.5 cm and a diameter of 10 mm. The pushrod (2); the bottom of which is flat and unornamented and the sides are identical and symmetrical; is a 10 mm dowel made from Japanese cypress with a length of 20 cm and it has a slight indentation in the tip, wherein the tip of the glove appendage fits. The tube (3) bamboo; the bottom of which is flat and unornamented and the sides are identical and symmetrical; has an inside diameter of 13 mm and an outside diameter of 14 mm with length of 14 cm. The tip of the tube (3) is tapered, which facilitates smooth engagement of the glove appendage socket.

Conclusions, Ramifications, and Scope

Accordingly, the reader will see that my glove inverter can be used easier, more efficiently and more effectively than performing this procedure by hand. In addition, by using my glove inverter, complete inversion is accomplished much more expediently. Furthermore, my glove inverter provides a highly reliable, lightweight, detachable, portable, yet economical device that can be used by persons of almost any age.

Although the detailed description above contains specificities, these should not be construed as limitations on the scope of the invention, but rather as an exemplification of one preferred embodiment thereof.

Other variations are possible. For example, the size of all of the elements of this device can be larger or smaller, longer or shorter, thicker or thinner. The material employed to construct the elements can be natural, artificial, or composite material. Any color or combination of colors can be applied. The shape of the base (1) can be triangular, rectangular, round, square, etc. The device can be used without the base (1).

Furthermore all of the elements of this device can be made from material(s) that can be rigid or flexible, but capable of withstanding the pressure necessary to preform its function without fracturing or otherwise rendering it inoperable.

What is claimed:

1. A device for the inversion of glove finger appendages comprising:

a) a small portable base which fits in the palm of a hand and has an opening, b) a pushrod of a diameter to receive a standard glove finger appendage wherein the pushrod is inserted into the base opening to be securely mounted therein, c) a hollow tube of a diameter to sufficiently fit over the pushrod without hindrance, where the exterior tip of the tube is tapered inwardly to facilitate engagement of the glove finger base, wherein the pushrod may receive a glove finger appendage, the pushrod is inserted through the hollow tube to invert the glove finger, further wherein the base, pushrod, and hollow tube are easily detachable for making the device portable.

* * * * *